US006181359B1

(12) United States Patent
Nakanishi

(10) Patent No.: US 6,181,359 B1
(45) Date of Patent: Jan. 30, 2001

(54) COLOR THERMOSENSITIVE PRINTER AND OPTICAL FIXING DEVICE THEREFOR

(75) Inventor: Kanji Nakanishi, Saitama (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/572,837

(22) Filed: May 16, 2000

(30) Foreign Application Priority Data

May 26, 1999 (JP) ..... 11-146990

(51) Int. Cl.[7] ..... B41J 2/315; B41J 2/32; B41M 5/26; B41M 5/34

(52) U.S. Cl. ..... 347/175

(58) Field of Search ..... 347/175

(56) References Cited

FOREIGN PATENT DOCUMENTS 2753166 2/1998 (JP) ..... B41J/2/32

*Primary Examiner*—Huan Tran

(74) *Attorney, Agent, or Firm*—Sughrue, Mion, Zinn, Macpeak & Seas, PLLC

(57) ABSTRACT

There is disclosed a color thermosensitive printer which has a thermal head mounted on a carriage to scan the thermal head in opposite directions across a width of a color thermosensitive recording the recording paper. Yellow and magenta fixing members have linear tube lamps that are disposed across the width of the recording paper along the scanning directions of the thermal head. First and second exposure openings are formed through the carriage before and behind the thermal head with respect to a forward scanning direction. As the carriage moves in the forward scanning direction, the thermal head records yellow pixels on a yellow thermosensitive color layer of the recording paper, and the yellow fixing rays are projected onto the recording paper through the second exposure opening that follows behind the thermal head in the forward scanning direction. As the carriage moves in the reverse scanning direction, the thermal head records magenta pixels on a magenta thermosensitive color layer of the recording paper, and the magenta fixing rays are projected onto the recording paper through the first exposure opening that follows behind the thermal head in the reverse scanning direction.

19 Claims, 9 Drawing Sheets

COLOR THERMOSENSITIVE PRINTER AND OPTICAL FIXING DEVICE THEREFOR

BACKGROUND OF THE INVENTION

1. Field of the Invention

The present invention relates to a color thermosensitive printer that uses a color thermosensitive recording paper. The present invention relates more particularly to an optical fixing device for the color thermosensitive printer, that provides uniform optical fixation of the color thermosensitive recording paper while taking illuminance variation into consideration.

2. Background Arts

The color thermosensitive recording paper has at least three thermosensitive coloring layers, i.e., cyan, magenta and yellow thermosensitive coloring layers, formed on atop another on a base material. Among these coloring layers, the obverse coloring layer has the highest thermal sensitivity, so it develops color with the lowest heat energy. The deeper from the obverse, the lower the thermal sensitivity of the coloring layer, so it requires the higher heat energy for coloring the deeper coloring layer. To print a full-color image, heating elements of a thermal head are pressed onto the obverse surface of the recording paper, to record pixels of at least three colors sequentially from the obverse coloring layer. Prior to recording on the next thermosensitive coloring layer, coloring capability of the upper thermosensitive coloring layer is extinguished by exposing to rays of a wavelength range that is specific to that coloring layer, so the upper coloring layer would not develop color even though higher heat energy is applied for recording on the next coloring layer.

One known kind of color thermosensitive printer utilizes a thermal head that extends in a direction transverse to a paper conveying path, and records a line of pixels at a time on the color thermosensitive recording paper. In this type of printer, called a color thermosensitive line printer, one color frame of a full-color image, e.g. a yellow frame, is recorded line by line on the yellow coloring layer as the recording paper is moved along the paper conveying path in synchronization with the line recording of the thermal head. The next color frame, e.g. a magenta frame, is recorded line by line after the yellow thermosensitive coloring layer is optically fixed. After the magenta coloring layer is optically fixed, a cyan frame is recorded line by line. This method is called a three-color frame sequential recording. In many of this type of printers, linear tube lamps that extend transversely to the paper conveying path are used for projecting the optical fixing rays.

Although the linear tube lamp is inexpensive and is able to project a large quantity of light with high efficiency, illuminance of the lamp lowers in end portions of its glass tube adjoining its caps or bases. Therefore, it is difficult to expose the recording paper to the optical fixing rays uniformly across the width without a long linear tube lamp that extends sufficiently beyond the width of the recording paper.

There is another type of color thermosensitive printer, called a color thermosensitive serial printer, wherein a small thermal head is mounted on a carriage, and is scanned across the width of the recording paper (main scanning), while the recording paper is moved intermittently in a lengthwise direction relative to the thermal head (sub scanning). Because of the small thermal head, the serial printer can be more compact and less expensive than the line printer.

JPA 5-124352 discloses a color thermosensitive serial printer that records a full-color image in a three-color line sequential fashion. That is, the thermal head serially records yellow pixels along the width of the recording paper while scanning in a forward direction across the width of the recording paper. Thereafter the thermal head serially records magenta pixels while scanning in a reverse direction on the same line as the first forward scanning. Then, the thermal head serially records cyan pixels on the same line as the yellow and magenta pixels while scanning again in the forward direction. After pixels of the three colors are recorded on the same line, the recording paper is advanced by one line, and three-color pixels are recorded on the next line in the same way as above.

To fix the previously recorded pixels, a small optical fixing lamp for yellow is disposed on the carriage behind the thermal head with respect to the forward scanning direction, and is turned on during the thermal recording for yellow and magenta. On the other hand, a small optical fixing lamp for magenta is disposed on opposite side of the thermal head from the yellow fixing lamp, i.e., behind the thermal head with respect to the reverse scanning direction, and is turned on during the thermal recording for magenta and cyan. Because of this configuration, time efficiency of thermal recording and optical fixing is remarkably improved.

However, the small optical fixing lamps are expensive because they are of special type. Due to their small size, the luminous intensities of these lamps are so small that it takes more time to apply a sufficient quantity of light enough for optical fixing. Besides that, since the lamps as well as the thermal head are mounted on the scanning carriage, complicated wiring is necessary for supplying and controlling them.

SUMMARY OF THE INVENTION

In view of the foregoing, an object of the present invention is to provide a color thermosensitive printer, whereby uniform optical fixation is achieved at high speed without the need for expensive optical fixing lamps and complicated wiring.

To achieve the above objects, in a color thermosensitive printer that prints a full-color image on a color thermosensitive recording paper having a plurality of thermosensitive coloring layers, the present invention comprises: a thermal head pressed onto an obverse of the color thermosensitive recording paper for heating the color thermosensitive recording paper so as to make thermal recording on the thermosensitive coloring layers sequentially from the obverse; an optical fixing device for optically fixing the previously recorded thermosensitive coloring layer prior to thermal recording on the next thermosensitive coloring layer, the optical fixing device comprising a linear tube lamp extending across a width of the color thermosensitive recording paper, and an exposure opening through which the color thermosensitive recording paper is exposed to optical fixing rays from the linear tube lamp, the exposure opening being formed through a light-tight member that is movable along the linear tube lamp in between the linear tube lamp and the color thermosensitive recording paper; and a device for moving the light-tight member along the linear tube lamp while the linear tube lamp is turned on.

According to the present invention, it is unnecessary to mount small special optical fixing lamps on the carriage, so electric wiring is simplified. Instead, a conventional linear tube lamp is used as the optical fixing lamp, so it is possible to apply a sufficient quantity of light to the recording paper, and the cost is lowered as well.

To achieve uniform optical fixation, the linear tube lamp is controlled such that exposure amount of the color thermosensitive recording paper to the optical fixing rays through the exposure opening is maintained constant.

According to a preferred embodiment, the luminous intensity of the linear tube lamp is controlled depending upon illuminance values of the lamp measured at predetermined positions of the exposure opening in the widthwise direction of the recording paper. Thereby, it is possible to compensate for variations in the illuminance, and equalize the exposure amount of the recording paper to the optical fixing rays. Even though illuminance is always low at its end portions as compared to its middle portion, since the luminous intensity is increased when the exposure opening is opposed to the end portions of the tube, it comes to be possible to utilize the entire length of the linear tube lamp for fixing. Thus, the length of the lamps may be minimized, so the printer may be more compact.

By providing a light guide device for directing the optical fixing rays from the linear tube lamp to the exposure opening, the optical fixing rays are efficiently projected onto the color thermosensitive recording paper while being prevented from leaking to those portions which are being subjected to thermal recording afterward.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
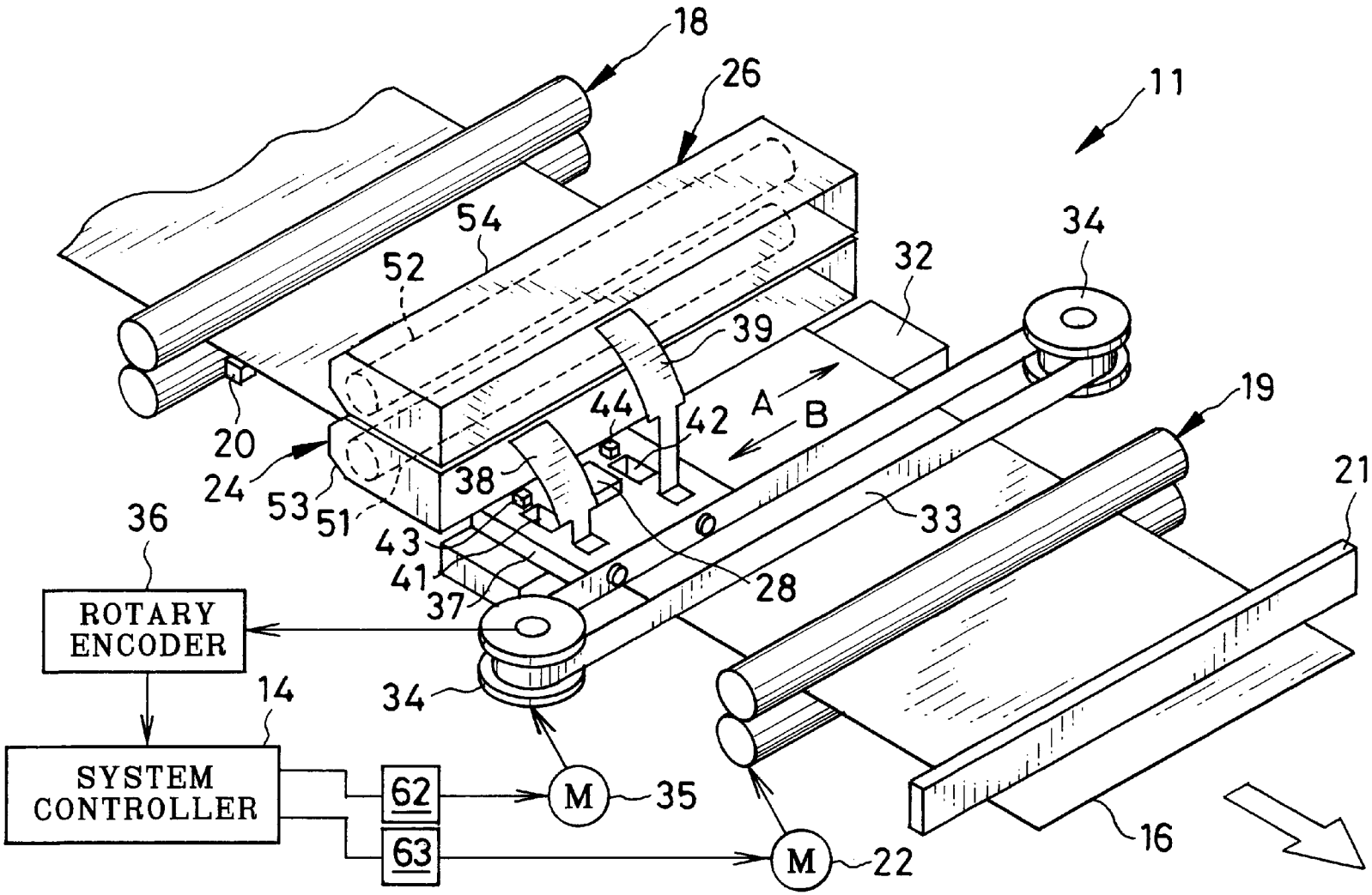
FIG. 1 is a schematic diagram illustrating essential parts of a color thermosensitive serial printer according to a first embodiment of the present invention.

A color thermosensitive serial printer 11 shown in FIG. 1 uses a long web of rolled color thermosensitive recording paper, hereinafter called the recording paper 16. As conventional, the recording paper 16 has cyan, magenta and yellow thermosensitive coloring layers formed on a base material in this order toward an obverse recording surface.

The recording paper 16 is conveyed along a paper path through at least two pairs of conveyer rollers 18 and 19, which are driven by a paper conveyer motor 22 to rotate bi-directionally. A leading end sensor 20 for detecting a leading end of the recording paper 16 is disposed near behind the conveyer roller pair 18 in a paper advancing direction shown by an arrow in FIG. 1. A cutter 21 is disposed behind the downstream conveyer roller pair 19, in order to cut off a leading portion of the recording paper 16 after a full-color image is recorded on the leading portion.

In a printing stage, there are provided optical fixing members 24 and 26 for yellow and magenta, a thermal head 28, and a platen 32 for supporting the recording paper 16 from its back side opposite to the recording surface. The thermal head 28 is integrally mounted on a light-tight plate member called carriage 37. The carriage 37 is secured to a circular conveyer belt 33 that is suspended between a pair of pulleys 34 disposed on opposite lateral sides of the paper path. Thus, the carriage 37 is moved transversely to the paper path by rotating the pulleys 34.

The pulleys 34 are driven by a second motor 35 to rotate bi-directionally. A rotary encoder 36 is mounted to the pulley 34, for outputting a signal representative of a rotational amount of the pulley 34. The output signal from the rotary encoder 36 is sent to a system controller 14 that detects from the output signal a position of the carriage 37 in the widthwise direction of the recording paper 16, called a main scan direction. The system controller 14 controls the overall operation of the printer 11. As will be described in more detail later, the thermal head 28 records a full-color image in the three-color line sequential fashion as the carriage 37 reciprocates across the width of the recording paper 16.

Figure 2:
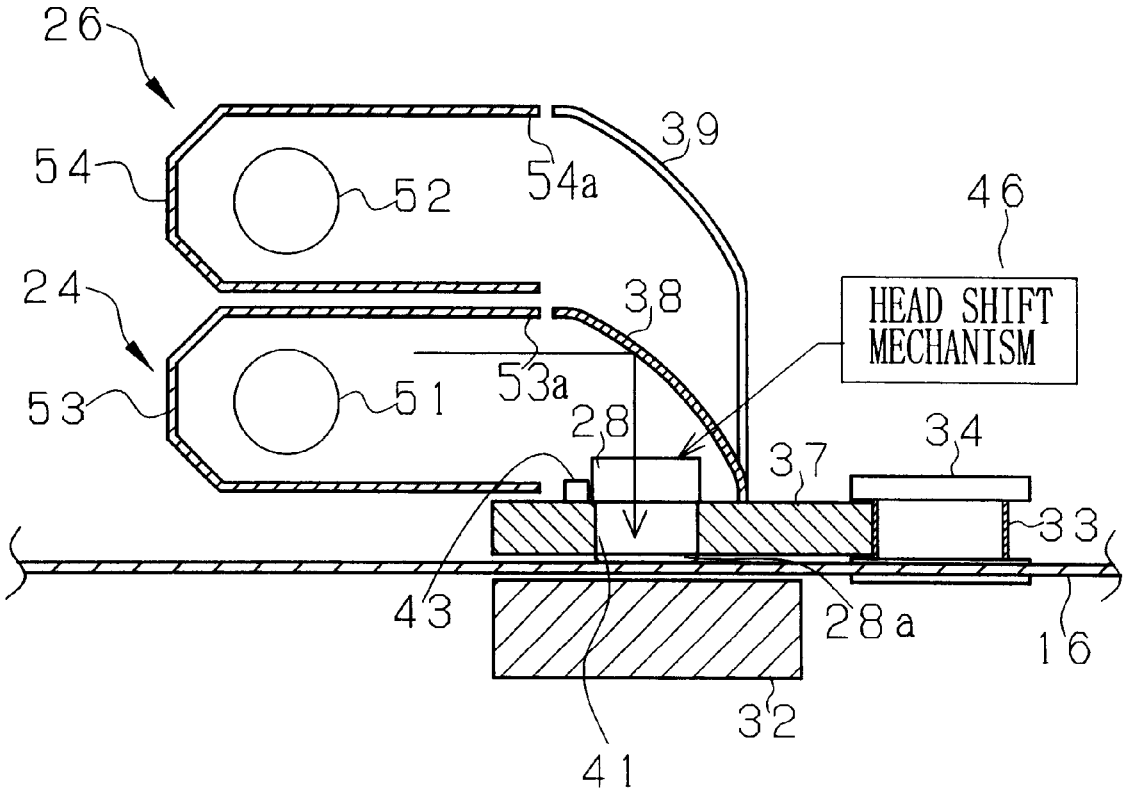
FIG. 2 is a sectional view of an optical fixing device of the first embodiment.

The system controller 14 controls driving the motors 35 and 22 through motor drivers 62 and 63 respectively, such that the recording paper 16 is advanced intermittently after each line is recorded along the main scan direction. The motors 22 and 35 are pulse motors in this embodiment. As shown in FIG. 2, the thermal head 28 is moved up and down through a head shift mechanism 46, so as to press a heating element array 28*a* of the thermal head 28 onto the recording paper 16 for thermal recording. The heating elements array 28*a* consists of a plurality of, e.g. thirty, heating elements arranged in a line transverse to the main scan direction. Therefore, pixels are recorded in rows at one main scanning of the thermal head 28. Hereinafter, the rows of pixels recorded at one main scanning will be called a main scanning line.

The yellow fixing member 24 consists of an yellow fixing lamp 51 radiating near-ultraviolet rays having a peak wavelength of 420 nm and a reflector 53, whereas the magenta fixing device 26 consists of a magenta fixing lamp 52 radiating ultraviolet rays having a peak wavelength of 365 nm and a reflector 54. The yellow and magenta fixing lamps 51 and 52 extend across the width of the recording paper 16. The optical fixing members 24 and 26 are arranged vertically from each other with respect to the recording surface of the recording paper 16. This arrangement contributes to reducing the whole size of the printer 11. As shown in detail in FIG. 2, each of the reflectors 53 and 54 has only one end open, and these open ends 53*a* and 54*a* are oriented forward in the paper advancing direction, in order to prevent the recording paper 16 from being exposed to the optical fixing rays of the optical fixing members 24 and 26 before the thermal head 28.

Two exposure openings 41 and 42 are formed through the carriage 37 on opposite side of the thermal head 28 with respect to the main scan direction. A reflection plate 38 for directing the yellow fixing rays from the yellow fixing member 24 toward the exposure opening 41 and a reflection plate 39 for directing the magenta fixing rays from the magenta fixing device 26 toward the exposure opening 42 are securely mounted on the carriage 37. Thus, the recording paper 16 is exposed to the yellow fixing rays or the magenta fixing rays through the exposure opening 41 or 42 respectively. As shown in FIG. 2, there is a very narrow gap between the carriage 37 and the recording paper 16.

There are also disposed two illuminance sensors 43 and 44 on the carriage 37 near the exposure openings 41 and 42 respectively. The illuminance sensors 43 and 44 measure illuminance of the yellow fixing rays and the magenta fixing rays, and output detection signals at regular time intervals to the system controller 14 during the movement of the carriage 37. Thus, the system controller 14 monitors actual illuminance values of the optical fixing rays in many positions of the exposure openings 41 and 42 in the main scan direction.

Figure 3:
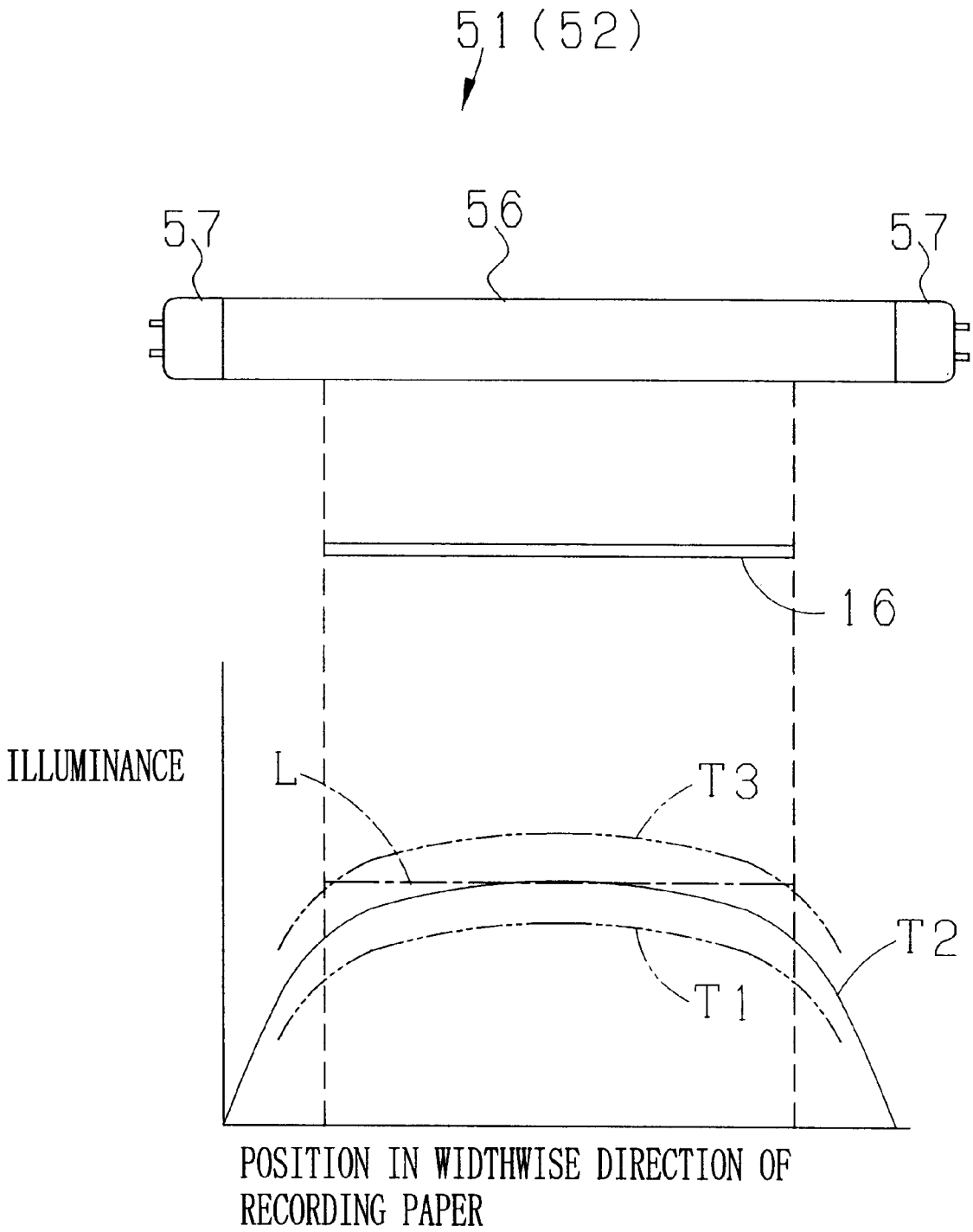
FIG. 3 is an explanatory diagram illustrating illuminance distribution curves of an optical fixing lamp in a widthwise direction of a thermosensitive color recording paper.

Each of the optical fixing lamps 51 and 52 is a linear tube lamp that consists of a linear glass tube 56 and caps 57 on ends of the glass tube 56, as shown in FIG. 3. Illuminance of the linear tube lamp in general is the lowest at the ends of the glass tube 56 near the caps 57, and gets higher toward the middle of the glass tube 56. Besides that, the illuminance generally varies with temperature of the glass tube 56 itself, as shown by curves T1, T2 and T3, among which T1 corresponds to the lowest tube temperature, and T3 the highest tube temperature.

In FIG. 3, a level L represents a set illuminance level of the optical fixing rays to be projected onto the recording paper 16 through the exposure opening 41 or 42. The set illuminance level L is previously input in the system controller 14, so the system controller 14 controls the optical fixing lamp 51 or 52 so as to equalize the actual illuminance values measured through the illuminance sensor 43 or 44 to the set illuminance level L at any positions of the carriage 37 in the main scan direction. Thereby, the illuminance of the optical fixing rays projected onto the recording paper 16 through the exposure openings 41 or 42 is maintained approximately constant.

Figure 4:
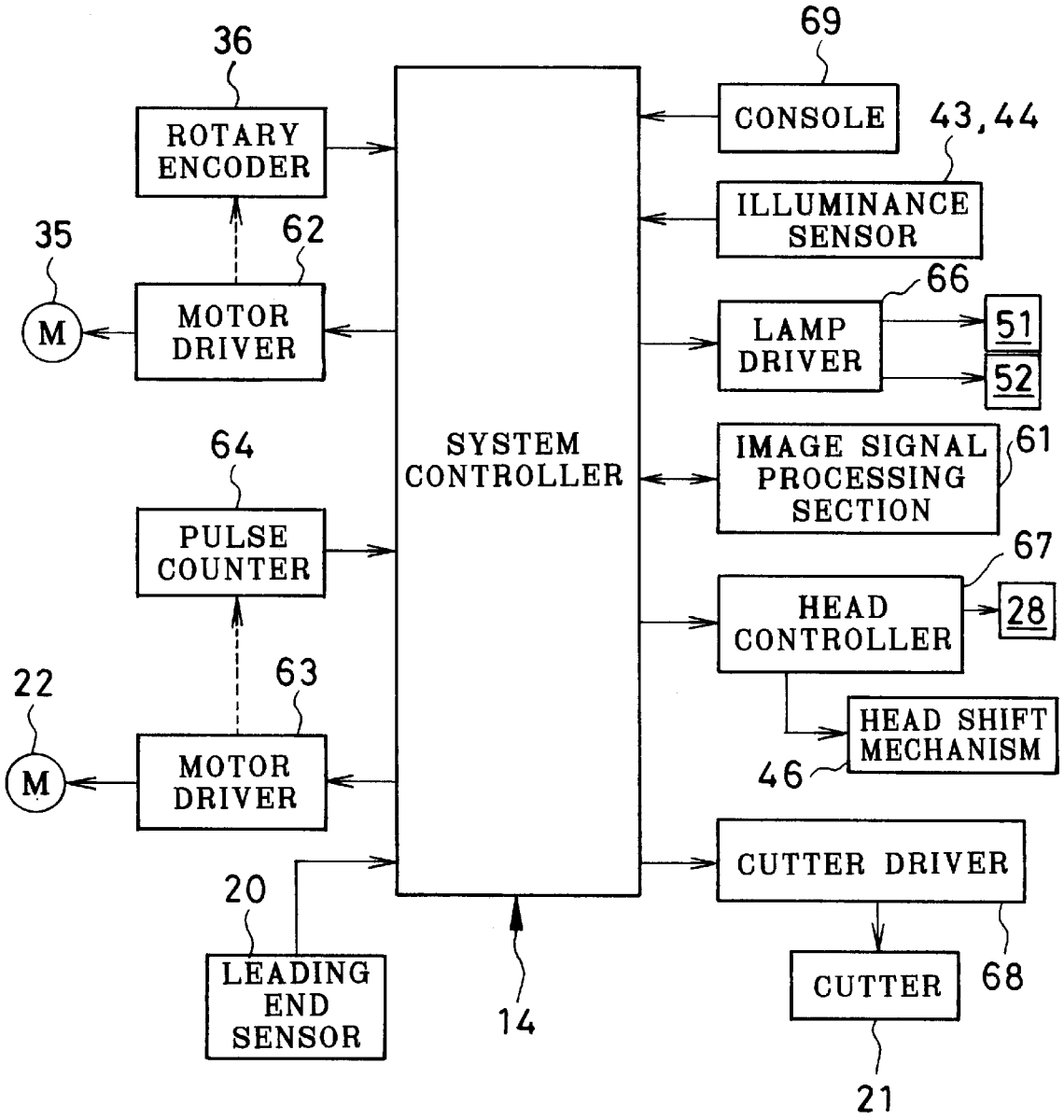
FIG. 4 is a block diagram of the color thermosensitive serial printer.

FIG. 4 shows a circuitry of the printer 11. As described above, the system controller 14 is connected to the rotary encoder 36, the illuminance sensor 43 and 44, and the motor drivers 62 and 63. Also the leading end sensor 20, an image signal processing section 61, a pulse counter 64, a lamp diver 66, a head controller 67, a cutter driver 68 and a console 69 are connected to the system controller 14.

The pulse counter 64 counts drive pulses applied for driving the paper conveyer motor 22, and the system controller 14 detects an advanced length of the recording paper 16 based on the count of the pulse counter 64. A print size of an image, a print start position and a print stop position for the image on the recording paper 16 are previously designated through the console 69, so the system controller 14 controls timing, direction and amount of conveying the recording paper 16 in accordance with the print size and the print start and stop positions, while monitoring the advanced length of the recording paper 16.

The system controller 14 also controls the motor driver 62, the head controller 67, and the lamp driver 66 while monitoring the position of the carriage 37 in the main scan direction that is detected through the rotary encoder 36. The head controller 67 drives the thermal head 28 in accordance with image data from the image signal processing section 61. The head controller 67 also drives the head shift mechanism 46. The lamp driver 66 drives the yellow and magenta fixing members 24 and 26, as will be described in detail below.

Figure 5:
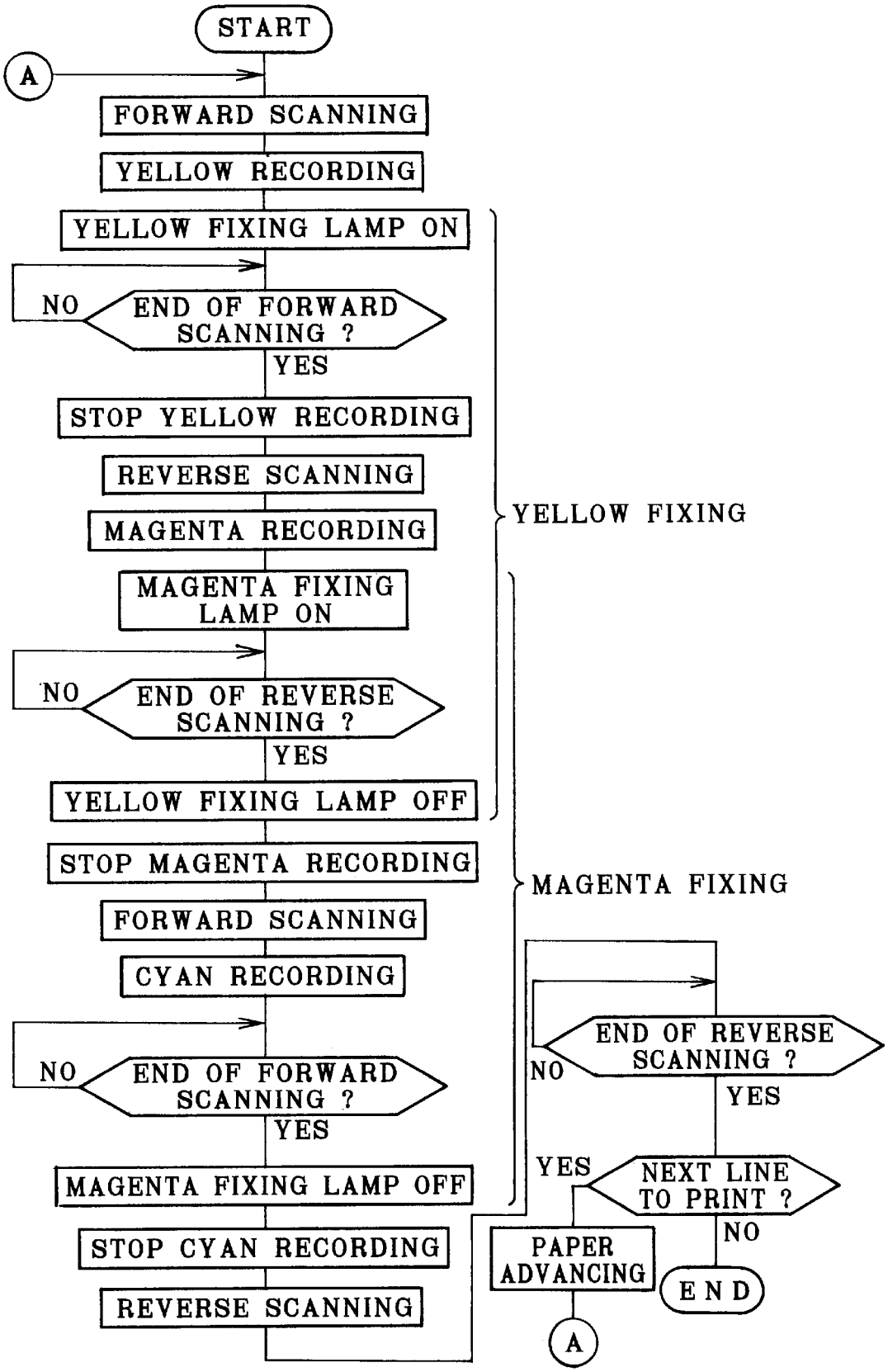
FIG. 5 is a flow chart illustrating the operation of the color thermosensitive serial printer.

Now the operation of the printer 11 will be described with reference to FIG. 5.

Responsive to a print command entered through the console 69, the system controller 14 starts driving the paper conveyer motor 22 in a forward direction to convey the recording paper 16 in the advancing direction. When the leading end sensor 20 detects the leading end of the recording paper 16, the system controller 14 activates the pulse counter 64 to count up drive pulses applied to the paper conveyer motor 22 for rotating it in the forward direction. When it is determined based on the count of the pulse counter 64 that the designated print start position on the recording paper 16 is placed in front of the heating element array 28*a* of the thermal head 28, the system controller 14 stops the paper conveyer motor 22.

Then the head shift mechanism 46 is activated to press the heating element array 28*a* onto the recording paper 16, and the motor 35 is driven to rotate in a forward direction to move the carriage 37 from an initial position in a forward scanning direction A, as shown in FIG. 1. Simultaneously, the thermal head 28 starts recording yellow pixels serially on the yellow thermosensitive coloring layer of the recording paper 16. Also the yellow fixing lamp 51 is turned on to project the yellow fixing rays onto the recording paper 16 through the exposure opening 41. Because the exposure opening 41 for the yellow fixing rays is located behind the thermal head 28 in the forward scanning direction A, the yellow pixels of a first main scanning line are optically fixed immediately after being recorded.

During the optical fixation by the yellow fixing member 24, the system controller 14 controls the driving power to the yellow fixing lamp 51 through the lamp driver 66 with reference to the actual illuminance values of the yellow fixing rays detected at regular intervals through the illuminance sensor 43, so as to make the actual illuminance values equal to the set illuminance level L for the yellow fixation at any positions across the width of the recording paper 16. The driving power is controlled by changing duty factor of the driving power. But it is possible to control the driving power by changing the voltage level, the driving frequency, or the phase of the voltage or the current.

When the system controller 14 determines based on the output signals from the rotary encoder 36 that the carriage 37 reaches a terminal position of a moving range that is determined by the print size as well as the width of the recording paper 16, the system controller 14 stops driving the motor 35 and the thermal head 28. Thus, thermal recording of yellow pixels of the first main scanning line is concluded. Immediately thereafter, the motor 35 starts being driven in a reverse direction to move the carriage 37 in a reverse scanning direction B reverse to the forward scanning direction A. Simultaneously, the thermal head 28 starts recording magenta pixels serially along the first main scanning line.

During the magenta pixel recording, the magenta fixing lamp 52 is turned on to project the magenta fixing rays onto the recording paper 16 through the exposure opening 42. Because the exposure opening 42 is located behind the thermal head 28 in the reverse scanning direction B, the magenta thermosensitive coloring layer of the recording paper 16 is fixed immediately after the magenta pixels are recorded thereon. On the other hand, the yellow fixing lamp 51 stays ON during the magenta recording. Because the exposure opening 41 for the yellow fixing rays is located before the thermal head 28 in the reverse scanning direction B, the yellow fixing rays are projected onto the recording paper 16 again along the first main scanning line immediately before the magenta pixels are recorded.

When the carriage 37 returns to an initial position, the motor 35 stops rotating in the reverse direction, the thermal head 28 concludes the magenta pixel recording, and the yellow fixing lamp 51 is turned off. Then, the motor 35 stars rotating in the forward direction to move the carriage 37 in the forward scanning direction A again. Simultaneously, the thermal head 28 starts recording cyan pixels on the cyan thermosensitive coloring layer of the recording paper 16 along the first main scanning line. During the cyan pixel recording, the magenta fixing lamp 52 stays ON to continue fixing the magenta pixels of the first main scanning line.

In this way, the yellow and magenta fixing members 24 and 26 keep on projecting the optical fixing rays onto the recording paper 16 while the carriage 37 makes one round across the width of the recording paper. Which makes it possible to apply a sufficient amount of optical fixing rays to the recording paper 16 even if the carriage 37 is moved at a high speed. Therefore this configuration contributes to reducing time for printing three color pixels in one main scanning line, and thus the total printing time of one full-color image. It is however possible to turn on the yellow or magenta fixing lamp 51 or 52 only during the yellow recording or the magenta recording respectively.

When the carriage 37 reaches the terminal position and thus the thermal head 28 completes recording cyan pixels, the motor 35 and the thermal head 28 are deactivated. Also the magenta fixing lamp 52 is turned off. Then the head shift mechanism 46 is activated to lift the thermal head 28 and remove the heating element array 28*a* away from the recording paper 16. Then, the motor 35 is driven in the reverse direction to move the carriage 37 back to the initial position. Simultaneously, the paper conveyer motor 22 is driven in a forward direction to advance the recording paper 16 by an amount corresponding to one main scanning line.

After the recording paper 16 is advanced by one main scanning line and the carriage 37 reaches the initial position, the sequence for thermal recording and optical fixation of a second main scanning line is executed in the same way as for the first main scanning line. The advanced length of the recording paper 16 is always monitored through the count of the pulse counter 64.

When a full-color image has been printed in this way, the recording paper 16 is advanced continuously till a trailing position of the recording paper 16 behind the full-color image is placed under the cutter 21, and the cutter 21 cuts the recording paper 16 into a sheet along the trailing position. The trailing position is determined by the print size. The sheet with the full-color image printed thereon is ejected from the printer 11. Then, the paper conveyer motor 22 is driven in a reverse direction to convey the recording paper 16 back to a paper initial position for starting printing the next image. To locate the recording paper 16 in the paper initial position, the recording paper 16 is first moved backward till a new leading end is detected by the leading end sensor 20, and is then moved in the advancing direction. When the leading end is detected, the pulse counter 64 is reset to zero, and starts counting the drive pulses to monitor the advanced length of the recording paper 16.

Figure 6:
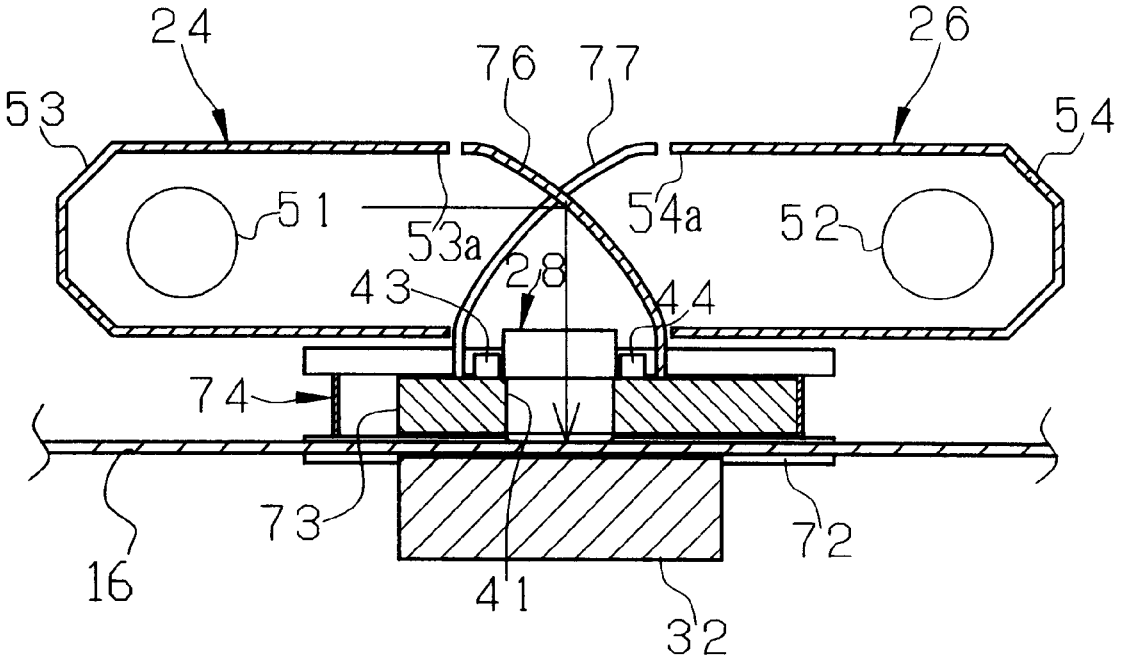
FIG. 6 is a sectional view of a variation of optical fixing device.

Although the magenta fixing member 26 is laid over the yellow fixing member 24 in the above embodiment, it is possible to arrange these optical fixing members 24 and 26 horizontally from each other with respect to the recording paper 16, as shown in FIG. 6. In this embodiment, the open ends 53*a* and 54*a* of the reflectors 53 and 54 are opposed to each other. This embodiment uses pulleys 72 with a relatively large diameter for suspending a circular conveyer belt 74, so a carriage 73 is disposed inside the conveyer belt 74, and is secured at its one side to the belt 74. Reflection plates 76 and 77 for the yellow fixing rays and the magenta fixing rays have the same height, and are disposed in between the optical fixing members 24 and 26. This arrangement contributes to reducing the height of the printer. Although the open end of one of the optical fixing members, i.e. the magenta fixing member 26 in this instance, is oriented rearward with respect to the paper advancing direction, since the optical fixing rays projected rearward from the magenta fixing member 26 is shielded by the other yellow fixing member 24, the recording paper 16 is not exposed to the optical fixing rays before it is placed under the exposure opening 42.

In the above embodiment, the optical fixing lamps 51 and 52 are individually controlled so that the actual illuminance values measured through the illuminance sensors 43 and 44 are maintained at the respective set level L. However, because the exposure amount to the magenta fixing rays need not to be maintained constant, but should be kept above a predetermined level, it is possible to drive the magenta fixing lamp 52 always at a full duty factor or with a maxim driving power, and control the illuminance of the yellow fixing lamp 51 only, in order to prevent over- or under-exposure of the recording paper 16 to the yellow fixing rays.

Figure 7:
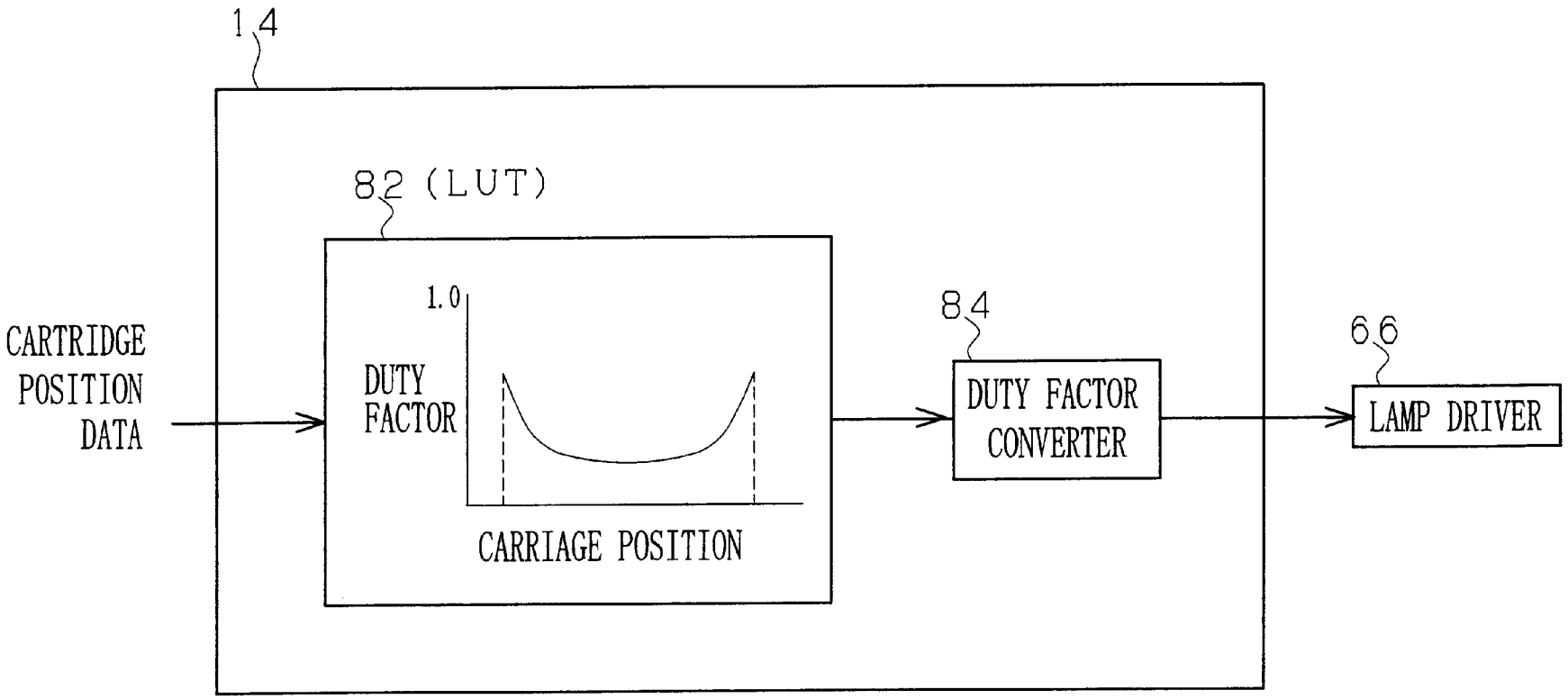
FIG. 7 is a functional block diagram illustrating an operation for controlling driving power to the optical fixing lamp with reference to a lookup table.

As shown in FIG. 7, it is possible to control the driving power to the yellow fixing lamp 51 with reference to a lookup table memory 82 (LUT) that stores data of duty factors of the supply voltage to the lamp 51. The duty factors vary with respect to the position of the carriage 37 in the main scan direction, and are determined based on the illuminance distribution of the yellow fixing lamp 51 with respect to the lengthwise direction of the tube 56 (see FIG. 3), such that the variations in the duty factor compensate for the variations in the illuminance of the lamp 51 along the tube 56.

In this embodiment, the system controller 14 reads out a duty factor from the LUT 82 depending upon the position of the carriage 37 detected through the rotary encoder 36, and converts the duty factor into a duty factor signal through a duty factor converter 84. Based on the duty factor signal, the lamp driver 66 controls the duty factor of the drive power to the lamp 51, thereby to maintain the exposure amount of the recording paper 16 to the yellow fixing rays constant across the width of the recording paper 16. The magenta fixing lamp 52 may be always driven at a full duty factor in this embodiment. It is of course possible to control the duty factor of the driving power to the magenta fixing lamp 52 in the same way with reference to a lookup table. Since the illumination sensors 43 and 44 are not needed in this embodiment, electric wiring of the carriage 37 is simplified, and the cost is reduced.

Figure 8:
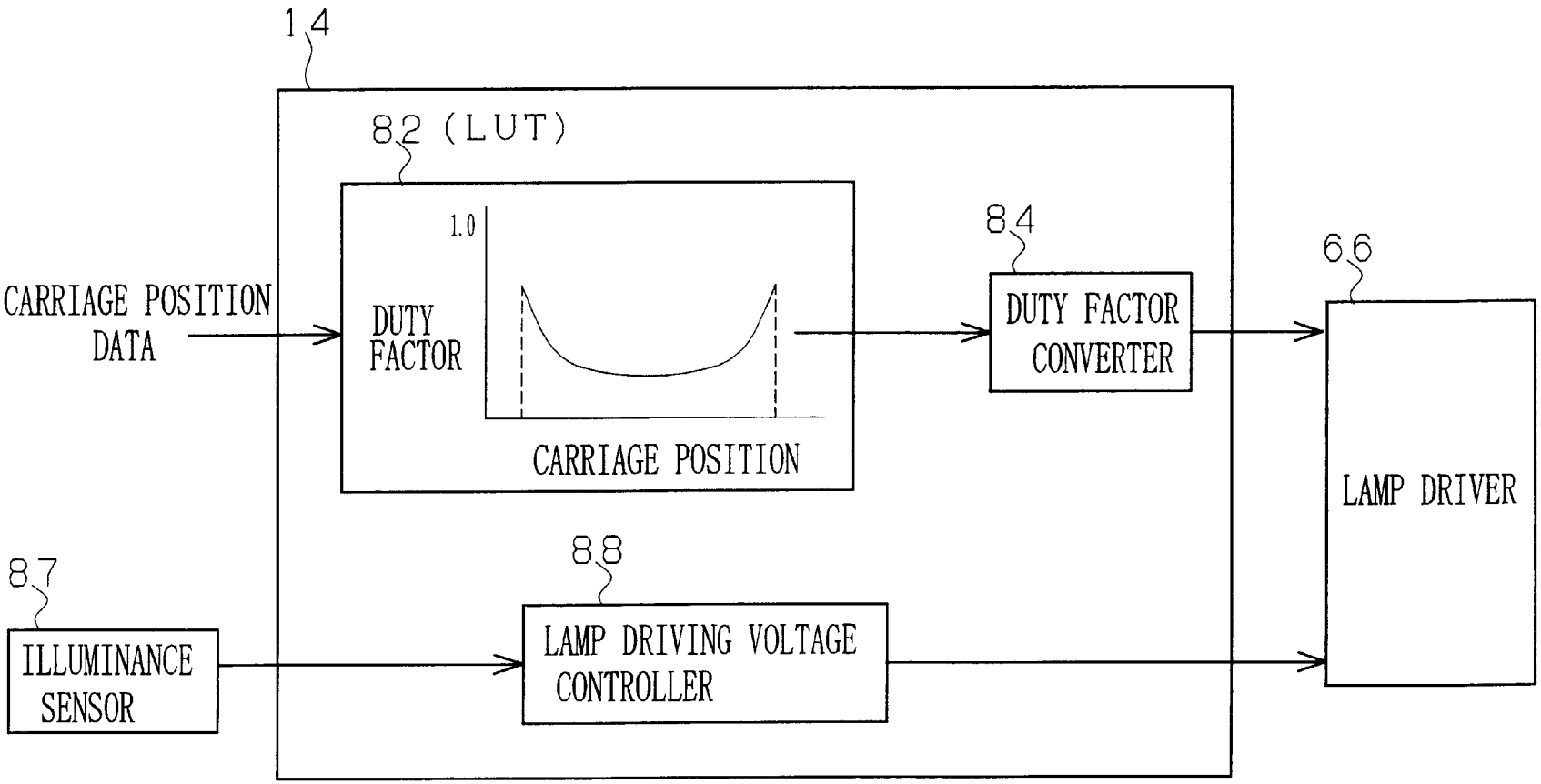
FIG. 8 is a functional block diagram illustrating an operation for controlling driving power of the optical fixing lamp by use of the lookup table and an illuminance sensor in combination.

In a modification as shown in FIG. 8, in order to take the tube temperature variations into account in addition to the illuminance distribution along the tube 56, an illuminance sensor 87 is mounted in the yellow fixing member 24, so as to control the voltage level of the driving power to the lamp 51 based on variations in illumination values measured through the illumination sensor 87. In this embodiment, a lamp drive voltage controller 88 is provided in addition to the LUT 82. A reference illuminance value of the lamp 51 at the mounting position of the illuminance sensor 87 is previously written in the lamp drive voltage controller 88, so the lamp drive voltage controller 88 compares the measured illuminance value with the reference illuminance value. When the illuminance of the yellow fixing lamp 51 generally increases or decreases because of the variation in tube temperature or other reasons, and thus the measured illuminance value deviates from the reference value, the lamp drive voltage controller 88 controls the voltage level so as to adjust the illuminance at the mounting position to the reference illuminance value.

Since the illuminance sensor 87 is mounted fixedly in the yellow fixing member 24, wiring of the carriage 37 is simplified, while it is possible to monitor the illuminance of the yellow fixing lamp 51. Needless to say, it is possible to mount an illuminance sensor in the magenta fixing device 26 and control the drive voltage as well as the duty factor of the driving power to the magenta fixing lamp 52 for the same purpose as above. It is also possible to mount a temperature sensor in either or both of the yellow and magenta fixing members 24 and 26 instead of the illuminance sensor.

Figure 9:
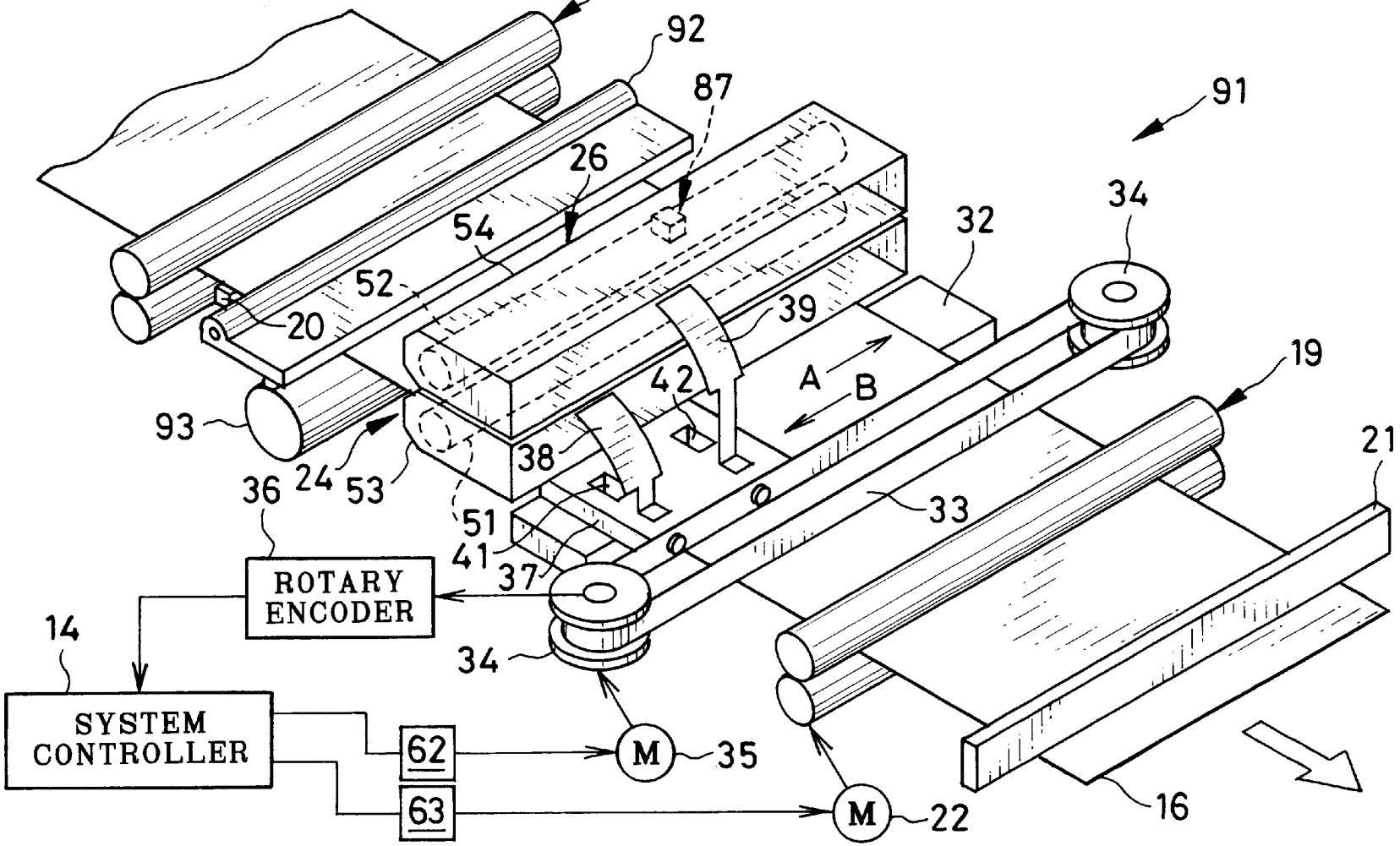
FIG. 9 is a color thermosensitive line printer according to another embodiment of the present invention.

Although the present invention has been described so far with respect to a color thermosensitive serial printer, the present invention may be applicable to a color thermosensitive line printer, as shown for example in FIG. 9. The line printer 91 has a thermal head 92 that is provided with a large number of heating elements arranged in a line across the width of the recording paper 16. A platen roller 93 is disposed on opposition to the thermal head 92, to support the recording paper 16 from the back side. A full-color image is printed in the three-color frame sequential fashion. The thermal head 92 records each color frame line by line as the recording paper 16 moves in one direction in synchronization with the thermal recording.

For instance, a yellow frame is recorded line by line as the recording paper 16 moves in an advancing direction shown by an arrow. After the entire yellow frame is recorded, the recording paper 16 is moved intermittently backward. A yellow fixing lamp 51 is turned on while the recording paper 16 is moving backward. A carriage 37 is caused to make one round across the width of the recording paper 16 during each intermission of the backward movement of the recording paper 16, to fix the recorded yellow frame line by line and serially within the line. After the entire yellow frame is optically fixed, a magenta frame is recorded line by line as the recording paper 16 moves in the advancing direction, and a magenta fixing lamp 52 is turned on while the recording paper 16 is moving backward. The carriage 37 reciprocates one time during each intermission of the backward movement, to optically fix the magenta frame line by line in the same way as for the yellow frame. After the entire magenta frame is fixed, a cyan frame is recorded line by line as the recording paper 16 is advanced. Thereafter the recording paper 16 having the full-color image thereon is cut and ejected.

It is possible to execute the above optical fixation process immediately after the thermal recording while the recording paper 16 is being advanced, instead of or in addition to the optical fixation during the backward movement of the recording paper 16. In any cases, illuminance of the lamp 51 or 52 may be controlled so as to maintain the exposure amount of the recording paper 16 to the yellow or the magenta fixing rays constant in the entire area of the color frame, by using one of the controlling methods as described above with respect to the serial printer.

It is possible to equalize the exposure amount by controlling the speed of movement of the carriage 37 depending upon the illuminance variation of the optical fixing lamp, especially in the line printer.

The reflection plates are curved to get a higher light converging efficiency in the illustrated embodiments, but they may be a straight plate. In place of the reflection plates, it is possible to use light guide members made of a transparent plastic, a converging optical system or light conductors consisting of light-shielding walls for directing the optical fixing rays from the optical fixing members to the exposure openings.

Although the optical axes of the optical fixing rays are directed parallel to the recording surface in the above embodiments for the sake of preventing the optical fixing rays from falling directly on the recording paper, the optical axes of the optical fixing rays may be directed upward from the recording surface for the same purpose. Also in that case, the optical fixing rays are directed to the exposure openings through reflection plates or light guide members.

In order to prevent the recording paper from being exposed to the optical fixing rays in other portions than the exposure opening, the carriage may be provided with a light-tight film or blade that shields the recording paper from the optical fixing rays before and behind the carriage in the main scanning directions. Opposite ends of the light-tight film may be coiled around spools, so that the spools alternately rotate to wind up the film in one direction and the other with the movement of the carriage. It is alternatively possible to form the light-tight film or blade as bellows. With such a light-shielding device, it is possible to orient the open ends of the optical fixing members downward to project the rays directly to the exposure openings without the reflection plates or other kinds of light conducting members.

Instead of providing two optical fixing lamps for two colors, it is possible to use a single lamp and a band-pass filter that is inserted in front of the single lamp for fixing one color, and is displaced from the front of the single lamp for fixing another color. The sequence of recording three colors corresponds to the order of arrangement of the thermosensitive coloring layers from the obverse recording surface of the recording paper, and this order of arrangement is not limited to the above embodiment.

Although the recording paper is fed to the printing stage in form of a long web in the above embodiments, the present invention is applicable to a printer where a cut sheet of recording paper is successively fed to a printing stage.

Thus, the present invention is not to be limited to the above embodiments but, on the contrary, various modifications will be possible for those skilled in the art without departing from the scope of the invention as indicated by the appended claims.

What is claimed is:

1. A color thermosensitive printer that prints a full-color image on a color thermosensitive recording paper having a plurality of thermosensitive coloring layers, the color thermosensitive printer comprising:

a thermal head pressed onto an obverse of the color thermosensitive recording paper for heating the color thermosensitive recording paper so as to make thermal recording on the thermosensitive coloring layers sequentially from the obverse;

an optical fixing device for optically fixing the previously recorded thermosensitive coloring layer prior to thermal recording on the next thermosensitive coloring layer, the optical fixing device comprising a linear tube lamp extending across a width of the color thermosensitive recording paper, and an exposure opening through which the color thermosensitive recording paper is exposed to optical fixing rays from the linear tube lamp, the exposure opening being formed through a light-tight member that is movable along the linear tube lamp in between the linear tube lamp and the color thermosensitive recording paper; and a device for moving the light-tight member along the linear tube lamp while the linear tube lamp is turned on.

2. A color thermosensitive printer as claimed in claim 1, further comprising a paper conveying device for conveying the color thermosensitive recording paper intermittently along a length thereof relative to the linear tube lamp, wherein the light-tight member is moved along the linear tube lamp across the width of the color thermosensitive recording paper at each intermission of the color thermosensitive recording paper.

3. A color thermosensitive printer as claimed in claim 2, further comprising a control device for controlling the linear tube lamp such that exposure amount of the color thermosensitive recording paper to the optical fixing rays through the exposure opening is maintained constant.

4. A color thermosensitive printer as claimed in claim 3, wherein the thermal head is mounted on the light-tight member such that the exposure opening follows behind the thermal head to trace a track of the thermal head on the color thermosensitive recording paper as the light-tight member moves across the width of the color thermosensitive recording paper.

5. A color thermosensitive printer as claimed in claim 3, wherein the thermal head extends across the width of the color thermosensitive recording paper to make thermal recording line by line.

6. A color thermosensitive printer as claimed in claim 3, wherein the control device comprises an illuminance sensor mounted on the light-tight member to measure illuminance values of the linear tube lamp, and a device for controlling luminous intensity of the linear tube lamp depending upon the measured illuminance values.

7. A color thermosensitive printer as claimed in claim 3, wherein the control device comprises a position detecting device for detecting position of the exposure opening during the movement of the light-tight member along the linear tube lamp, a memory device storing lamp control values which are predetermined in relation to positions of the exposure opening along the linear tube lamp, and a device for controlling the linear tube lamp in accordance with the lamp control values depending upon the detected position of the exposure opening.

8. A color thermosensitive printer as claimed in claim 7, wherein the control device further comprises an illuminance sensor mounted stationary at a position near the linear tube lamp, and a device for controlling driving power to the linear tube lamp depending upon differences between illuminance values measured through the illuminance sensor and a reference illuminance value.

9. A color thermosensitive printer as claimed in claim 1, further comprises a light guide device for directing the optical fixing rays from the linear tube lamp to the exposure opening.

10. A color thermosensitive printer as claimed in claim 9, wherein the light guide device is mounted on the light-tight member to move together with the exposure opening.

11. A color thermosensitive printer that prints a full-color image on a color thermosensitive recording paper having first to third thermosensitive coloring layers formed in this order from an obverse, the color thermosensitive printer comprising:

a thermal head pressed onto the obverse of the color thermosensitive recording paper for heating the color thermosensitive recording paper so as to make thermal recording on the first to third thermosensitive coloring layers sequentially from the obverse;

a head carrying device for carrying the thermal head to scan the thermal head in forward and reverse directions across a width of the color thermosensitive recording paper;

a head driving device that drives the thermal head for thermal recording on the first thermosensitive coloring layer while the thermal head is scanning in the forward direction, and for thermal recording on the second thermosensitive coloring layer while the thermal head is scanning in the reverse direction;

first and second optical fixing lamps for projecting optically fixing rays for the first and second thermosensitive coloring layers respectively, the first and second optical fixing lamps extending across the width of the color thermosensitive recording paper;

a first exposure opening formed behind the thermal head in the forward scanning direction so as to move along with the thermal head;

a second exposure opening formed behind the thermal head in the reverse scanning direction so as to move along with the thermal head; and a lamp driving device that drives the first optical fixing lamp at least during the thermal recording on the first thermosensitive coloring layer, and the second optical fixing lamp at least during the thermal recording on the second thermosensitive coloring layer.

12. A color thermosensitive printer as claimed in claim 11, further comprising a paper conveying device for conveying the color thermosensitive recording paper intermittently along a length thereof relative to the thermal head, wherein the head carrying device reciprocates twice across the width of the color thermosensitive recording paper at each intermission of the paper conveying device, and the thermal head makes thermal recording on the first thermosensitive coloring layer during the first forward scanning, and on the second thermosensitive coloring layer during the first reverse scanning, and then on the third thermosensitive coloring layer during the second forward scanning at each intermission.

13. A color thermosensitive printer as claimed in claim 12, wherein the first optical fixing lamp is driven during the first forward scanning and the first reverse scanning of the head carrying device, and the second optical fixing lamp is driven during the first reverse scanning and the second forward scanning at each intermission.

14. A color thermosensitive printer as claimed in claim 11, wherein each of the optical fixing lamps projects the optical fixing rays in a direction other than toward the color thermosensitive recording paper, and the color thermosensitive printer further comprises a first light guide member for directing the optical fixing rays from the first optical fixing lamp to the first exposure opening, and a second light guide member for directing the optical fixing rays from the second optical fixing lamp to the second exposure opening.

15. A color thermosensitive printer as claimed in claim 14, wherein the light guide members are reflection plates that are carried on the head carrying device.

16. A color thermosensitive printer as claimed in claim 14, wherein the first and second optical fixing lamps are arranged vertically from each other with respect to the color thermosensitive recording paper.

17. A color thermosensitive printer as claimed in claim 14, wherein the first and second optical fixing lamps are arranged horizontally from each other with respect to the color thermosensitive recording paper.

18. A color thermosensitive printer as claimed in claim 11, further comprising a control device for controlling at least one of the first and second optical fixing lamps such that exposure amount of the color thermosensitive recording paper to the optical fixing rays through the first or the second exposure opening is maintained constant.

19. An optical fixing device for a color thermosensitive printer that prints a full-color image on a color thermosensitive recording paper having a plurality of thermosensitive coloring layers by heating the color thermosensitive recording paper to cause the thermosensitive coloring layers to develop sequentially different colors, while fixing the recorded thermosensitive coloring layer prior to thermal recording on the next thermosensitive coloring layer, the optical fixing device comprising:

a linear tube lamp extending across a width of the color thermosensitive recording paper;

an exposure opening formed through a light-tight member that is movable along the linear tube lamp in between the linear tube lamp and the color thermosensitive recording paper;

a device for moving the light-tight member along the linear tube lamp while the linear tube lamp is turned on;

a light guide device for directing optical fixing rays from the linear tube lamp to the exposure opening, so as to expose the color thermosensitive recording paper to the optical fixing rays only through the exposure opening; and a control device for controlling luminous intensity of the linear tube lamp in synchronization with the movement of the light-tight member, so as to keep illuminance of the optical fixing rays projected through the exposure opening at a predetermined level.

* * * * *